United States Patent [19]

Blumberg et al.

[11] 3,987,744

[45] Oct. 26, 1976

[54] AUTOMATIC SYSTEMS FOR THE DYNAMICALLY POSITIONING OF A FLOATING VESSEL

[75] Inventors: Jonathan Mark Blumberg, Creaton; Alan John Moore, Flackwell Heath, both of England

[73] Assignee: Gec-Elliott Automation Limited, England

[22] Filed: Nov. 22, 1974

[21] Appl. No.: 526,108

[30] Foreign Application Priority Data

Nov. 27, 1973 United Kingdom ..... 54879/73

[52] U.S. Cl. ..... 114/144 B; 60/229

[51] Int. Cl.[2] ..... B63H 25/04

[58] Field of Search ..... 60/39.15, 228, 229; 114/144 B; 235/150.1, 150.2, 150.21, 150.27; 318/588; 333/17 R; 340/6 R

[56] References Cited

UNITED STATES PATENTS

| | | | |
|---|---|---|---|
| 3,403,507 | 10/1968 | Schuster | 60/39.15 |
| 3,508,512 | 4/1970 | Desrayaud et al. | 114/144 B |
| 3,730,126 | 5/1973 | Zunderdorp et al. | 114/144 B |
| 3,867,712 | 2/1975 | Harthill et al. | 340/6 R |

*Primary Examiner*—Stephen G. Kunin

*Attorney, Agent, or Firm*—Kirschstein, Kirschstein, Ottinger & Frank

[57] ABSTRACT

The present invention relates to vessels which are propelled by two or more groups of thrusters and particularly to ships or oil drilling rigs in which it is desired to keep on a particular station. In some circumstances one of the thrusters is found to interfere with the operation of another thruster or to be overloaded when another thruster is not overloaded. The invention provides a method and apparatus for alleviating these problems.

2 Claims, 6 Drawing Figures

AUTOMATIC SYSTEMS FOR THE DYNAMICALLY POSITIONING OF A FLOATING VESSEL

This invention relates to methods and apparatus for controlling the propulsion of aquatic vessels, and aquatic vessels incorporating such apparatus.

The invention relates more particularly to vessels equipped with two or more spaced-apart steerable thrusters which are used to maneuver a vessel at sea, or in a dock or inland waterway, or any other body of water on which the vessel is floating or hovering. For the purpose of the present invention, the term "thruster" includes a group of thrusters situated at a location on the vessel the thrusters of which group are used in combination to provide a desired thrust in a desired direction. One thruster is generally mounted at the bow, and a similar or identical thruster or group of thrusters mounted at the stern. By "steerable" it is meant that each thruster can be controlled to provide thrust in any desired direction (relative to the vessel) in a horizontal plane. The thrust provided by each thruster or group of thrusters is also controllable in magnitude.

Thus two independent horizontal thrust vectors can be applied to the vessel. The transverse component of each vector is uniquely determined by the yaw (turning) and sway (sideways) forces required to be produced, but the division of surge (longitudinal) forces between the two is indeterminate. That is, while the total surge force is known, it can be produced by any arbitrary combination of individual surge forces. It has hitherto been proposed to divide the surge force requirements equally between bow and stern thrusters, but this leads to the undesirable situation that one thruster or group of thrusters may be overloaded while the other thruster or group of thrusters is still not fully loaded.

It is therefore an object of the invention to provide a method and apparatus for obviating or mitigating the above described problem.

According to a first aspect of the invention there is provided a method of controlling the propulsion of an aquatic vessel equipped with two spaced-apart steerable thrusters or groups of steerable thrusters each capable of exerting a controllably variable thrust in a desired direction in a horizontal plane, comprising the step of reproportioning the relative outputs of the thrusters or groups contributing to thrust along an axis joining the two thrusters or groups to maintain or to bring the output of one of these thrusters or groups below a predetermined level without changing the net levels of thrust along said axis, at right angles to said axis, or producing a turning movement about a vertical axis. The reproportioning may comprise the steps of initially equally setting the thrust contributions along said axis from each of the thrusters or groups, and subsequently reproportioning in one or more small increments and decrements at discrete time intervals to maintain said one output below said predetermined level, or until said one output is brought below said predetermined level. Thus the magnitude and direction of the two thrust vectors will each change in a manner which avoids overloading, but without changing the overall net thrust on the vessel.

Preferably, the method includes the further step of further reproportioning the relative outputs of the thrusters or groups should the thrust vector of either or both thrusters or groups be in an undesirable or other predetermined direction or directions. For example, where the thrusters are grouped in pairs, it would be undesirable to have any substantial output while the exhaust of one thruster of the pair was directed into the inlet of the other thruster of that pair.

According to a second aspect of the invention there is provided apparatus for controlling the propulsion of an aquatic vessel equipped with two spaced-apart steerable thrusters or groups of steerable thrusters each capable of exerting a controllably variable thrust in a desired direction in a horizontal plane, comprising detection means for detecting the approach to or exceeding of a predetermined level of output by one of said thrusters or groups, and reproportioning means for reproportioning the relative outputs of the thrusters or groups contributing to thrust along an axis joining the two thrusters or groups to maintain or to bring the output of said one thruster or group below said predetermined level without changing the net levels of thrust along said axis, at right angles to said axis, or producing a turning moment about a vertical axis. Said reproportioning means may comprise means for reproportioning in a succession of small increments and decrements spaced by discrete time intervals. Said apparatus preferably includes means for detecting the approach to or presence in an undesired or other predetermined direction or directions of one or both of the thrust vectors produced by the thrusters or groups, such that said reproportioning means reproportion the relative outputs of the thrusters or groups to keep the vector or vectors away from, and/or to remove the vector or vectors from said direction or directions, and/or to reduce the thrust vector or vectors below an undesirable or other predetermined level in said direction or directions.

Said method may be exercised by, and said apparatus constituted by a suitably programmed digital computer in conjunction with a suitable interface and transducers.

According to a third aspect of the invention there is provided an aquatic vessel including two spaced steerable thrusters or groups of steerable thrusters each capable of exerting a controllably variable thrust in a horizontal plane, incorporating apparatus according to the present invention for controlling the propulsion of said vessel by said thrusters or groups of thrusters.

Embodiments of the invention will now be described by way of example with reference to the accompanying drawings in which.

Figure 5A:
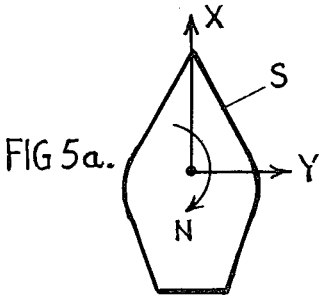
Figure 5B:
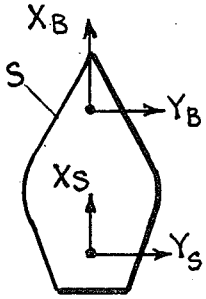

FIGS. 5*a*, 5*b* are explanatory diagrams and show the thrusts required to maintain a ship in a desired position.

Figure 1:
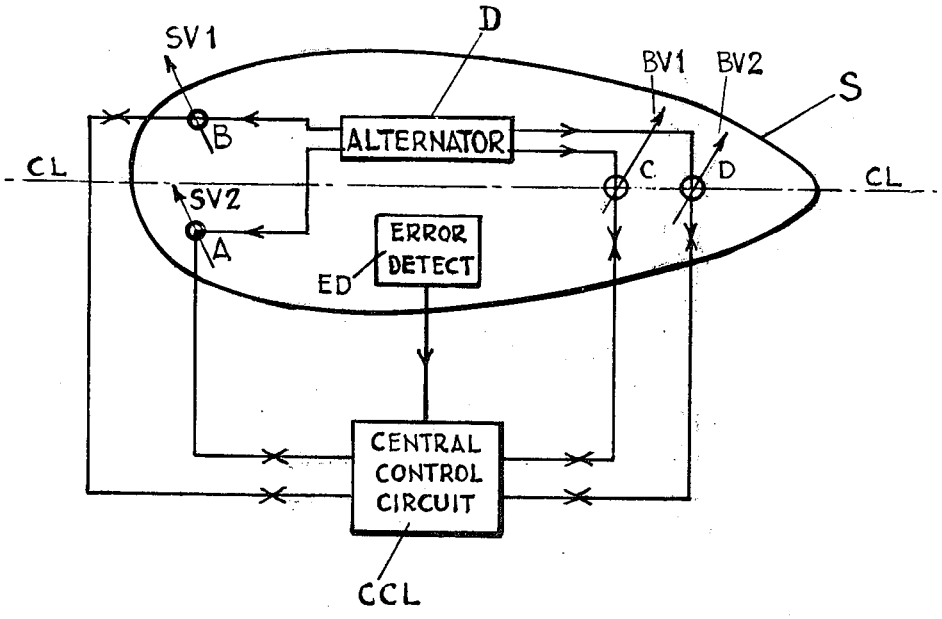
FIG. 1 shows diagrammatically a ship equipped with propulsion apparatus according to the present invention.

Referring to FIG. 1, a ship S carrying an oil drilling rig is equipped with two groups of steerable thrusters AB, and CD for maintaining the ship accurately positioned over a well-head on the seabed. One of these groups comprises a pair of thrusters mounted C, D beneath the bow of the ship, mutually aligned fore and aft along the center-line CL—CL of the ship, the thrusters each being turnable about a respective vertical axis and always pointing in the same direction. The other group of thrusters comprises a pair of thrusters AB identical to the bow thrusters and mounted under the stern of the ship to port and starboard of the centerline at the same distance aft. The stern thrusters are each turnable about a respective vertical axis always to point in the same direction.

The thrusters are all electrically driven at a nominally constant speed by alternating current from a diesel-driven alternator D, the diesel being governed for minimal speed variations over its load range.

Each of the bow and stern thrust vectors BV1, BV2, SV1, SV2 respectively produced by the bow and stern pairs of thrusters may, for the purposes of the following explanation, be considered as having a forward (or reverse) component and a transverse (port or starboard) component. The transverse components are uniquely determined by the sway and yaw forces required to keep the ship from moving sideways by more than predetermined distance from a point directly over the well-head, and to keep the ship heading in the selected direction. However, although the total forward (or reverse) thrust for counter-acting surge is known, the individual contributions of the pairs of thrusters can be arbitrarily divided between them. In the prior art arrangements, the contribution of bow and stern thrusters was made equal. In certain circumstances this lead to the combination of transverse and forward (or reverse) components giving a thrust vector magnitude of more than the rated output of the thruster.

In this embodiment of the present invention, the proportion of surge thrust contributions by bow and stern thrusters is initially made equal to the central control circuit CCL, and then as overload is approached or exceeded (as detected for example by a motor current measuring device), the outputs of the over-loaded pair of thrusters are reduced until they are at a satisfactory level, the reduction in surge thrust being compensated by a corresponding increase in surge thrust by the other pair of thrusters so as to keep total surge thrust at the required level. The transverse thrust components of both pairs of thrusters are not altered, since they could not be altered without changing the sway and yaw forces applied to the ship. Thus as well as thrust magnitude changes, thrust direction is changed, by suitably steering the thrusters.

The outputs of either pair of thrusters are also reduced in the cases where the output of one thruster of a pair is directed into the inlet of the other thruster of that pair. This situation occurs if the bow thrust vector is directed fore or aft, and if the stern thrust vector is directed to port or starboard. With such an additional reduction, a compensating change is made to the output of the other pair of thrusters.

The proportioning of surge thrusts is determined by a digital filter, and calculated at successive times separated by short discrete time intervals. Starting from a proportion $P = 0.5$, the value $P_n$ of the proportion of bow unit surge thrust to stern unit surge thrust at the time $n$ is related to the value $P_{n-1}$ of the proportion at the time n-1 by the formula:

$$P_n = (1 - \alpha)\, P_{n-1} + \alpha\,(0.5 + U_1 - U_2)$$

where $\alpha$ is a constant in a simple exponential type filter, typically of the order of 0.93, though possibly of some other suitable value; the values of $U_1$, $U_2$ are adjusted in accordance with the values of bow and stern thrust and the direction of bow and stern thrust as explained hereinafter with reference to FIGS. 2 to 5.

$U_1 = +0.5$ if bow unit surge thrust is to be increased;
$U_1 = -0.5$ if bow unit surge thrust is to be decreased;

and $U_2 = +0.3$ if bow unit thrust is to be reduced in the case where the thruster outputs of either pair are mutually interfering.
$U_1$, $U_2 = 0$ if no action is required.

Other reproportioning equations are possible within the scope of the invention and these may be obtained by suitable redesign of the digital filter.

Figure 2:
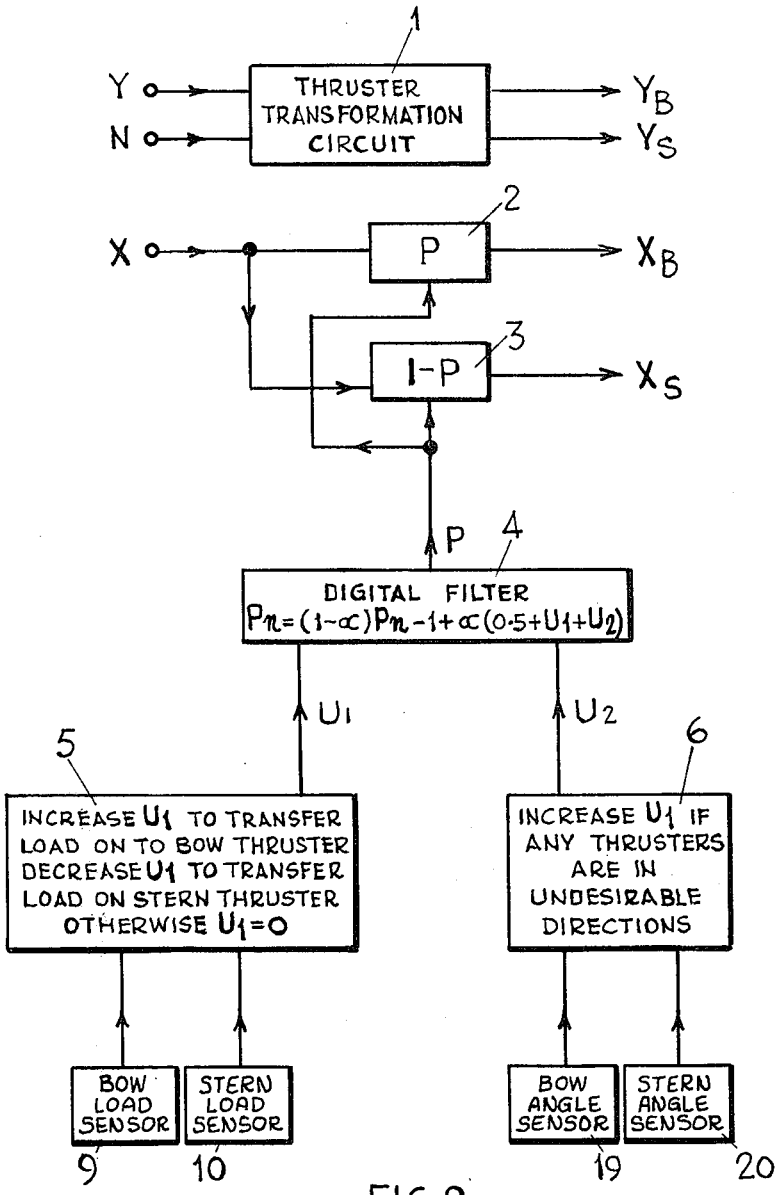
FIG. 2 shows a block diagram of apparatus according to the present invention for adjusting the proportion of power exerted by bow and stern thrusters of the ship S of FIG. 1.
Figure 3:
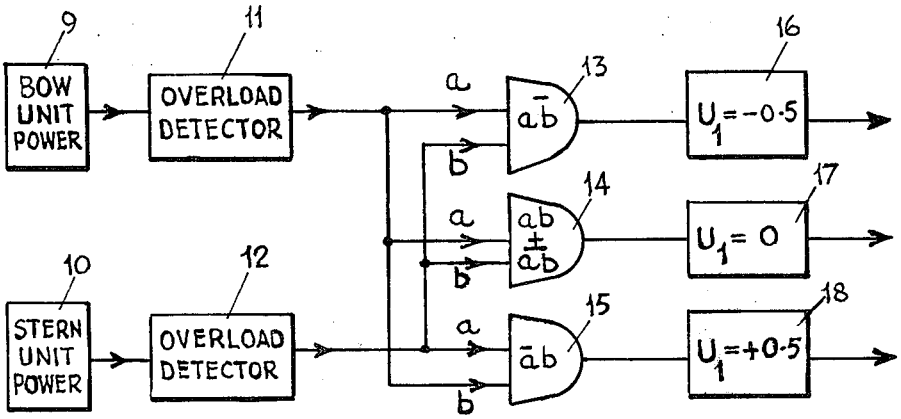
FIG. 3 shows in greater detail circuit 5 of FIG. 2.
Figure 4:
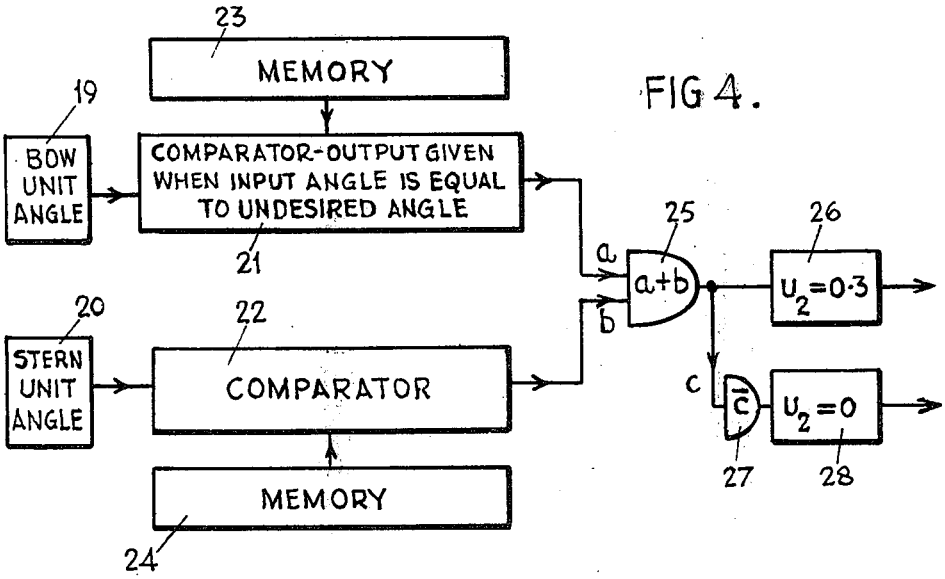
FIG. 4 shows in greater detail circuit 6 of FIG. 2.

Apparatus according to the present invention is shown in FIGS. 2, 3 and 4 in diagrammatic form and FIGS. 5*a*, 5*b* are explanatory diagrams showing the distribution between bow and stern thruster groups of the total thrust required.

Referring now to FIG. 5*a* the thrusts required to maintain a ship S on station are given by orthogonal thrusts X and Y and by a turning moment N. In FIG. 5*b* these required forces are distributed between bow and stern groups of thrusters which give thrusts in a direction such that vector thrusts $X_B$, $X_S$ and $Y_B$, $Y_S$ are produced. The thrusts $Y_B$ and $Y_S$ not only provide the required thrust Y but also provide the desired turning moment N.

Referring now to FIG. 2 there is shown apparatus for transforming required values of X, Y and N (calculated by ships instruments reading the wind velocity, tides currents etc., in known manner) into the values $Y_B$, $Y_S$ and $X_B$, $Y_S$. The transformation of Y and N into the thrusts $Y_B$, $Y_S$ is performed in a thruster transformation circuit 1. This transformation may be carried out by known means.

The thrust X is split into $X_B$ and $X_S$ by proportioning it in a ratio of P to 1-P in circuits 2, 3. These circuits could merely be potentiometers the sliders of which are adjusted according to the values of P input from the digital filter 4. The digital filter 4 performs the function given by the equation $Pn = (1 - \alpha)\, Pn\text{-}1 + \alpha(0.5 + U_1 - U_2)$ the values of $U_1$ and $U_2$ being set by the outputs of circuits 5 and 6 respectively. Circuits 5 and 6 produce respective outputs $U_1$, $U_2$ from the conditions of the bow and stern thrusters as measured by their associated instruments. Circuit 5 is responsive to the load on the thrusters and circuit 6 is responsive to the direction of the thrusters.

It can therefore be seen that if the value of $U_1$ or $U_2$ is changed by the circuit 5 or 6 then the value of P will change and therefore the distribution of thrust between the bow and stern thrusters will be changed.

The circuits of FIGS. 5 and 6 are now more fully described with reference to FIGS. 3 and 4 respectively.

Referring now to FIG. 3, the input variables are the Bow unit load and the Stern unit load obtained from respective sensors 9, 10 and these are fed as inputs to respective overload detectors 11, and 12. These detectors give for example a "1" output when the respective unit is overloaded. These digital outputs are used in gates 13, 14, 15 to provide outputs as shown when the input conditions to the gates (as shown within each gate) are satisfied. Thus for example when the bow unit is required to deliver too much power the overload detector 11 will give a "1" output and assuming the stern unit is not overloaded gate 13 will receive a "1" input on input "*a*" and a "0" input on input b. Thus the gate 13 will give an output to a circuit 16 which when triggered gives an output of $U_1 = -0.5$ which will be used in the digital filter 4 to reduce the bow unit power and increase the stern unit power. Similarly gates 14 and 15 give outputs to trigger their respective associated circuits 17, 18 when their input conditions are satisfied.

Referring now to FIG. 4 there is shown in more detail circuit 6 of FIG. 2 with inputs indicating the angles at which the bow and stern units are pointing, these input quantities being obtained from respective bow and stern sensors 19, 20. These angles are compared in comparators 21, 22 with lists of undesirable angles for the bow and stern units, these lists being held in respective memories 23, 24. When a comparison is made (within agreed tolerances) the output of the comparator becomes for example a digital "1" and the OR gate 25 transfers the output "1" to a circuit 26 which is triggered to produce an output $U_2 = 0.3$. This output is fed to the digital filter 4 to effect a reduction in the bow unit thrust.

If the output of both comparators is "0" then inverter 27 gives an output to circuit 28 which is triggered to produce an output $U_2 = 0$ thus requiring no alternation in bow thrust as a result of undesirable angles.

All undesirable angles for any particular ship or thruster arrangement can be stored in suitable memories 23, 24 by for example hard wiring. Comparison with input angles can be obtained by cycling the memories 23, 24 at fairly high speed by standard clocking procedures and comparing each stored value with the input value, allowing for values within a preset tolerance to be considered as equal comparisons.

While the invention has been described in relation to a ship having steerable thrusters depending into the water on which the ship floats, the invention is equally applicable to marine hovercraft having steerable propellers appended thereto, and producing thrust by reaction with the surrounding atmosphere.

The invention has been particularly described with respect to station-keeping, but it is also applicable to controlling the propulsion of aquatic vessels from one location to another. The invention can usefully be applied to cable-laying operations.

We claim:

1. A method of controlling the propulsion of an aquatic vessel equipped with two spaced-apart steerable thrusters each capable of exerting a controllably variable thrust in a desired direction in a horizontal plane, comprising the step of reproportioning the relative outputs of the thrusters contributing to thrust along an axis joining the two thrusters to maintain or to bring the output of one of these thrusters below a predetermined level without changing the net levels of thrust along said axis, at right angles to said axis, or producing a turning movement about a vertical axis, in which the reproportioning comprises the steps of initially equally setting the thrust contributions along said axis from each of the thrusters, and subsequently reproportioning thrust in one or more small increments and decrements at discrete time intervals to maintain said one output below said predetermined level, or until said one output is brought below said predetermined level.

2. Apparatus for controlling the propulsion of an aquatic vessel equipped with two spaced-apart steerable thrusters each capable of exerting a controllably variable thrust in a desired direction in a horizontal plane, comprising detection means for detecting the approach to or exceeding of a predetermined level of output by one of said thrusters, and reproportioning means for reproportioning the relative outputs of the thrusters contributing to thrust along an axis joining the two thrusters to maintain or to bring the output of said one thruster below said predetermined level without changing the net levels of thrust along said axis, at right angles to said axis, or producing a turning moment about a vertical axis, in which said reproportioning means comprises means for reproportioning thrust in a succession of small increments and decrements spaced by discrete time intervals.

* * * * *